US008038463B2

(12) United States Patent
Ferderer

(10) Patent No.: US 8,038,463 B2
(45) Date of Patent: Oct. 18, 2011

(54) DEVICE FOR SECURING A CONNECTOR

(75) Inventor: Albert Ferderer, Espelkamp (DE)

(73) Assignee: Harting Electric GmbH & Co. KG (DE)

( * ) Notice: Subject to any disclaimer, the term of this patent is extended or adjusted under 35 U.S.C. 154(b) by 1749 days.

(21) Appl. No.: 11/120,020

(22) Filed: May 2, 2005

(65) Prior Publication Data

US 2005/0250369 A1 Nov. 10, 2005

(30) Foreign Application Priority Data

May 7, 2004 (DE) ..... 20 2004 007 300 U

(51) Int. Cl.
*H01R 13/627* (2006.01)

(52) U.S. Cl. ..... 439/350

(58) Field of Classification Search ..... 439/350, 439/352, 357, 345, 385

See application file for complete search history.

(56) References Cited

U.S. PATENT DOCUMENTS

| | | | | |
|---|---|---|---|---|
| 2,143,562 | A * | 1/1939 | Kros | 439/356 |
| 3,215,969 | A * | 11/1965 | Verrone | 439/118 |
| 3,993,394 | A | 11/1976 | Cooper | 339/136 |
| 4,647,140 | A | 3/1987 | Crawford | 339/176 |
| 4,764,130 | A | 8/1988 | DiClemente | 439/686 |
| 5,123,721 | A * | 6/1992 | Seo | 312/333 |
| 5,803,760 | A * | 9/1998 | Ito et al. | 439/310 |
| 6,139,350 | A * | 10/2000 | Mathesius | 439/357 |
| 6,264,504 | B1 | 7/2001 | Wu | 439/607 |
| 6,340,310 | B2 * | 1/2002 | Henrici et al. | 439/346 |
| 6,478,631 | B1 | 11/2002 | Dutton et al. | 439/707 |
| 6,533,602 | B2 | 3/2003 | Nankou | 439/352 |
| 6,776,658 | B2 | 8/2004 | Tang | 439/607 |
| 2002/0151205 | A1 * | 10/2002 | Huetter et al. | 439/352 |

FOREIGN PATENT DOCUMENTS

| | | |
|---|---|---|
| CN | 1368768 | 11/2002 |
| CN | 2582214 | 10/2003 |
| DE | 2534292 | 7/1975 |
| DE | 101 04 288 | 1/2001 |
| EP | 0 420 458 | 9/1990 |
| JP | 2002-517075 | 11/2002 |
| WO | 99/62145 | 2/1999 |

OTHER PUBLICATIONS

Notification of First Office Action, issued in corresponding Chinese Application No. 2005110065289.6 on Mar. 3, 2007, 4 pgs.
Rejection Decision, issued in corresponding Chinese Application No. 200510065289.6 on Jan. 4, 2008, 5 pgs.
Action issued in corresponding Japanese Application No. 2005-136355 on Feb. 1, 2008, 4 pgs.
Action issued in corresponding Canadian Application No. 2,506,922 on Aug. 1, 2007, 3 pgs.

* cited by examiner

*Primary Examiner* — Tulsidas C Patel
*Assistant Examiner* — Vladimir Imas
(74) *Attorney, Agent, or Firm* — Hayes Soloway P.C.

(57) ABSTRACT

A device for securing a connector in an insulating module housing particularly a USB connector is disclosed. The module housing contains a connection region with at least one location spring arranged therein, wherein the spring end of the location spring is aligned in the connection direction. The spring ends protrude into the connection region so that connectors with non-standardized outside dimensions, inserted between the spring ends are prevented from falling out of the module housing.

9 Claims, 3 Drawing Sheets

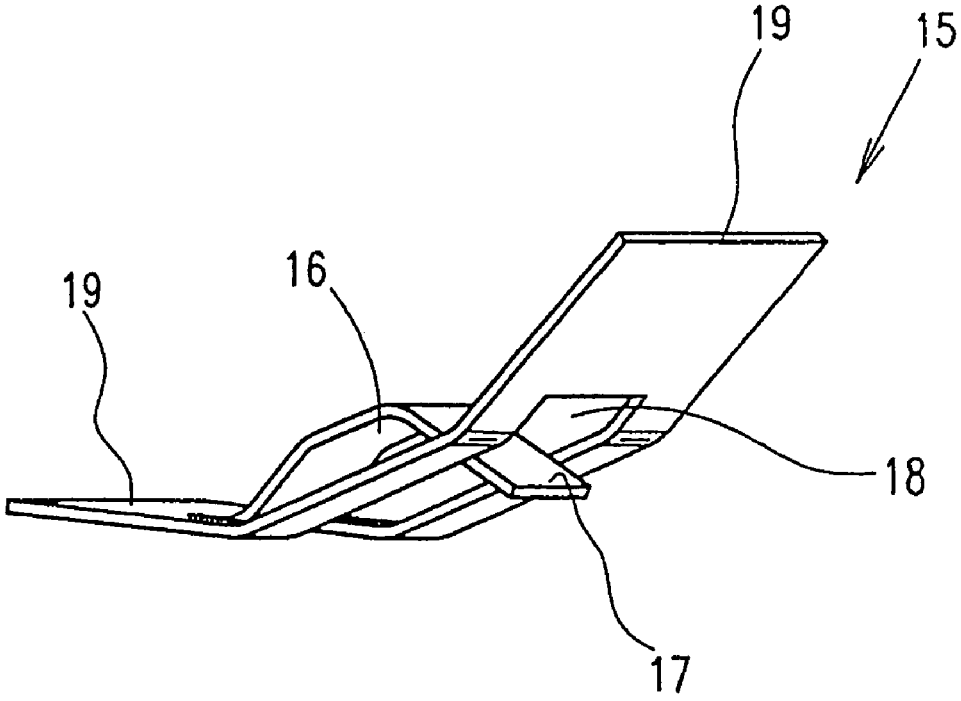
Fig.3
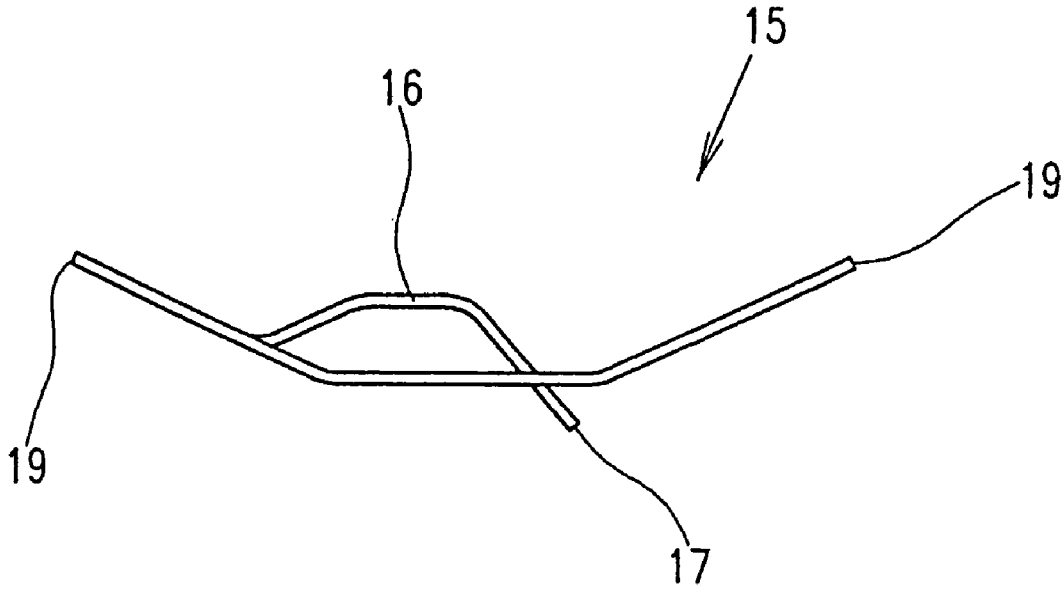

DEVICE FOR SECURING A CONNECTOR

TECHNICAL FIELD

The invention pertains to a device for securing a connector in an insulating module housing of a modular connector.

A device according to the invention is required for automatically interlocking a connector with a module housing or a mating connector.

BACKGROUND OF THE INVENTION

Conventional connector locking mechanisms utilize, among other things, screws, hooks, clamping devices or holding clips and always require corresponding manual activities. In the field of office communication interfaces, there is an increasing demand for a simple connecting mechanism that can be operated by any layman.

BRIEF SUMMARY OF THE INVENTION

Consequently, the invention is based on the objective of developing a device of the initially cited type for securing a connector in such a way that the connector and a corresponding module are automatically interlocked when the connection is produced.

This objective is attained in that the module housing contains a connecting region with at least one locating spring arranged therein, wherein the end of said locating spring is aligned in the connecting direction and protrudes into the connecting region.

The advantage attained with the invention can be seen, in particular, in that the connector to be inserted into a module is automatically interlocked therewith when this connection is produced, namely without requiring any additional activities to be performed by the person producing the connection.

There are no exact specifications or requirements with respect to the dimensions of the connectors that are usually delivered in the form of ready-made goods with extrusion-coated cables connected thereto, e.g., analogous to so-called USB connectors.

Symmetrically arranged locating elements are advantageously provided in the module housing for receiving such a connector housing, wherein said locating elements comprise locating springs that are directed into the connecting region of the module housing at a flat angle and secure the connector housing on both sides.

The module housing, in turn, can be engaged with or screwed to the frame of a modular connector that accommodates several modules.

When the connection is produced, the locating spring aligned in the connecting direction initially slides along the narrow sides in the connecting region of the connector housing, but immediately interlocks in the relatively soft housing wall of the connecting region when attempting to pull out the connector.

It is also advantageous that connector housings with largely non-standardized outside dimensions can be secured in the module housing even if they have a certain bandwidth.

BRIEF DESCRIPTION OF THE DRAWINGS

One embodiment of the invention is illustrated in the figures and described in greater detail below. The figures show:

FIG. 3, an individual spring element.

DETAILED DESCRIPTION OF THE PREFERRED EMBODIMENT

Figure 1:
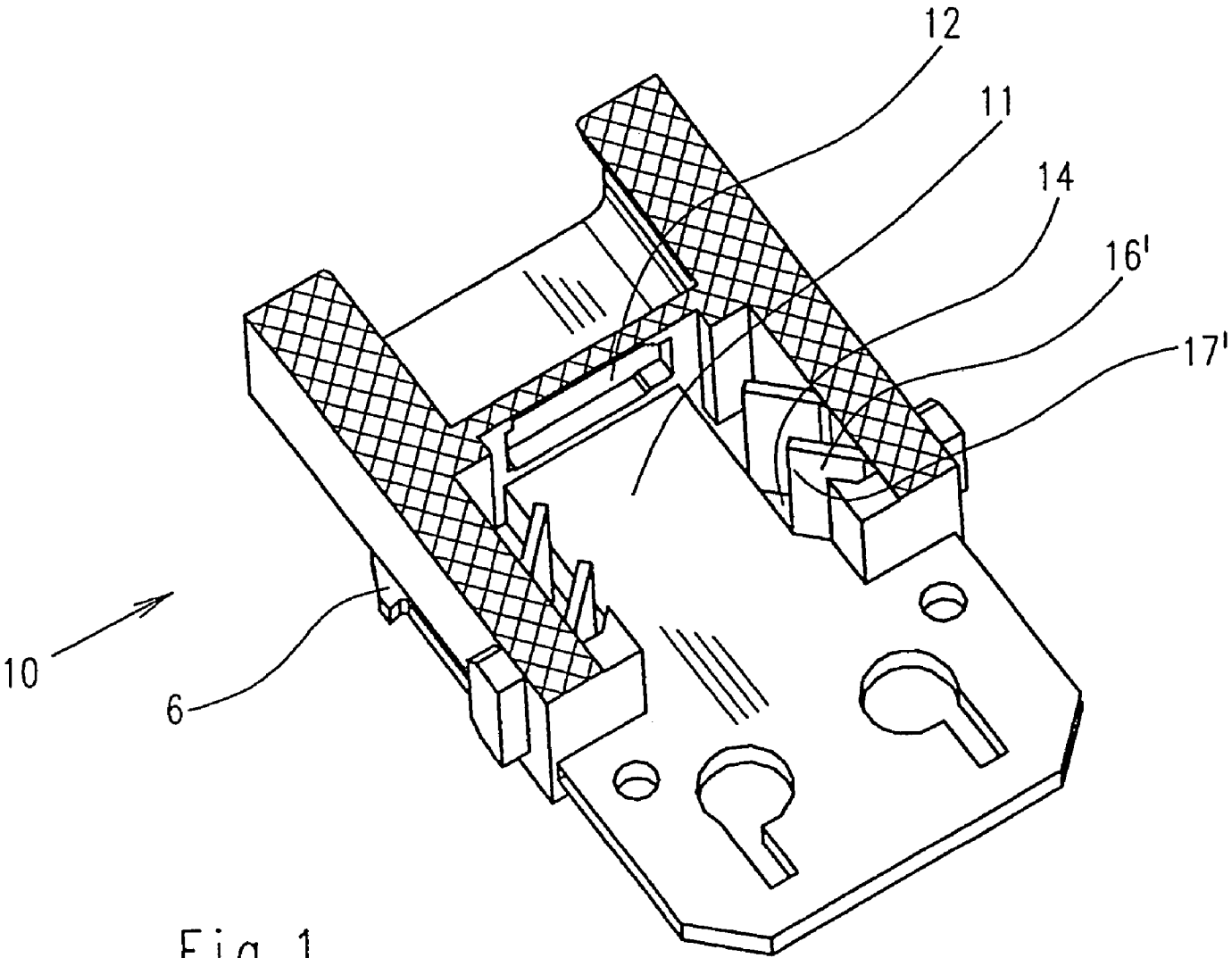
FIG. 1, a perspective representation of a sectioned module housing.

FIG. 1 shows a perspective representation of a sectioned module housing 10. Locating hooks 6 are integrally formed onto the respective outer edges in order to engage the module housing with the frame of a (not-shown) modular connector that also accommodates other module housings arranged in a row.

The module housing 10 contains a connecting region 11, as well as an opening 12, through which an inserted connector 1 protrudes in order to be contacted with a mating connector.

The connector 1 used is delivered in the form of a ready-made cable connection together with an electric cable 4. The cable connection is formed by the connector 1 consisting of a connector housing 2 with a connecting region 3, as well as a cable 4 connected thereto.

The connecting region 3 is delivered by the various connector manufacturers with a certain bandwidth, but with different dimensions. Consequently, one variably designed interlocking device can be advantageously utilized for securing a connector.

Such an interlocking device is provided in the connecting region 11 of the module housing, wherein at least one locating spring 16'—that extends into a depression 14 in the bottom of the module housing—is integrally formed onto the respective narrow sides of the module housing.

In this case, two successively arranged locating springs 16' are integrally formed in a graduated fashion onto both sides of the connecting region, wherein the ends 17' of said locating springs are directed into the connecting region 11 and aligned in the connecting direction at an angle of approximately 45° relative to the wall.

When the connector housing 2 is inserted into the module housing 10, the spring ends 17' initially slide along the narrow housing sides in the connecting region 5, but generate a wedge effect when attempting to pull out the connector.

Figure 2:
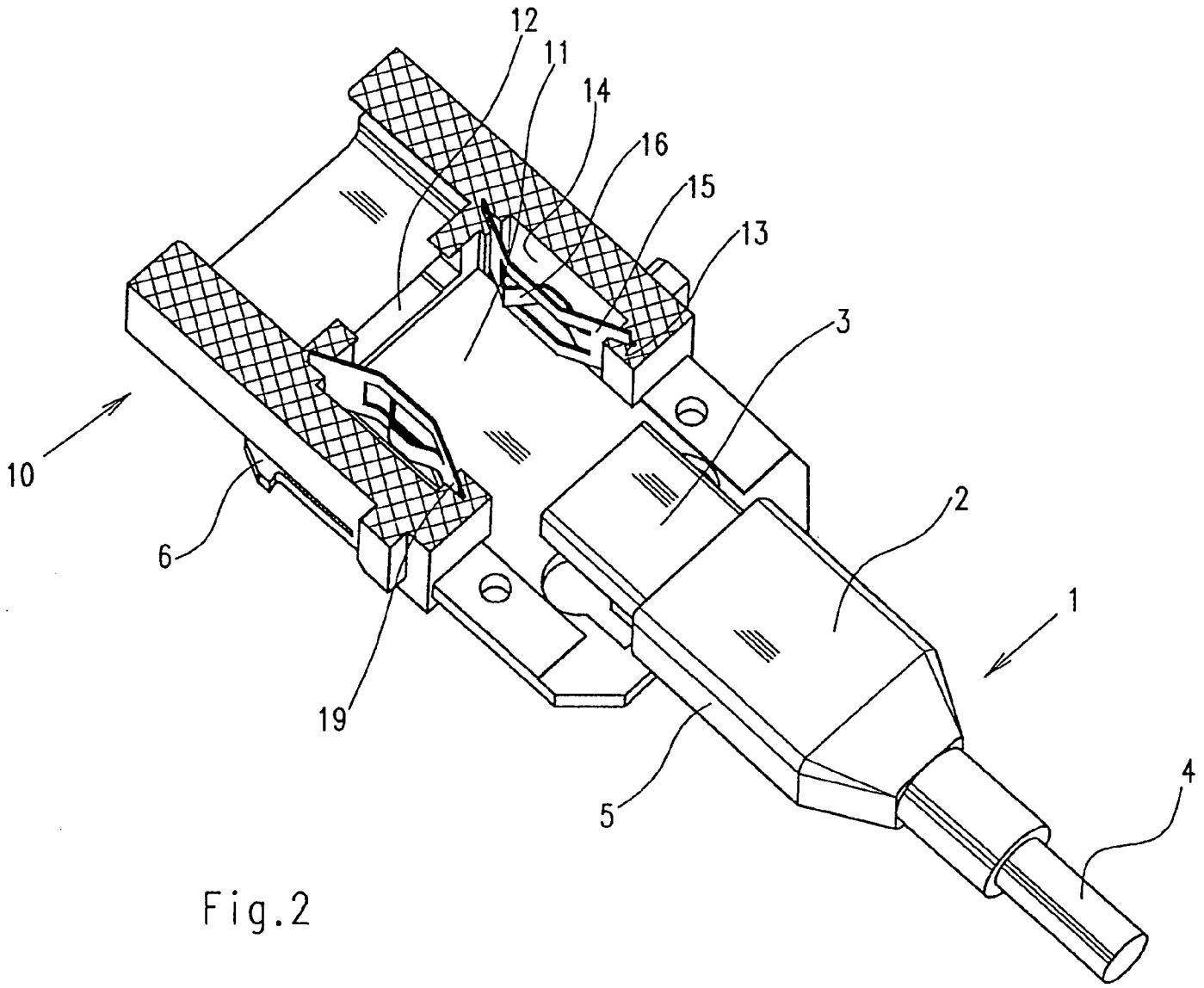
FIG. 2, a connector that is partially inserted into the module housing.

FIG. 2 shows a perspective representation of a connector 1 that already is partially inserted into a module housing 10 illustrated in the form of a section. A variation of the interlocking device shown in FIG. 1 is provided on this module, wherein two opposing spring elements 15 are arranged in the connecting region 11 such that they respectively point into the connecting region 11 with a locating spring 16 or with their end 17.

The spring elements 15 are secured in slots 13 with their ends 19 and captively inserted into the module housing through an installation opening 14 provided on one side.

When the connector 1 is additionally inserted into the module housing 10 until the connecting region 3 of the connector housing protrudes into the opening 12 in the module housing, the narrow sides of the connector housing slide along the locating springs 16, wherein the connector is prevented from sliding back out due to the alignment of the locating springs in the connecting direction.

FIG. 3 shows a spring element 15 that has a slightly U-shaped curvature, wherein a locating spring 16 that is cut out on three sides protrudes from the center of said spring element. The locating spring is initially bent in accordance with the curvature of the spring element, but protrudes from the opening 18 opposite to the curvature with the spring ends 17.

The curvature is required in order to hold the locating element within the slots 13 in the module 10 with a certain tension.

In order to separate the connector, the locating springs 16 need to be bent back from outside. This is achieved by inserting a flat tool for bending back the locating springs into the bottom opening 14 in the module housing 10.

However, this effort is quite justifiable in light of the fact that these connectors are incorporated into a system interface equipped with several modular connectors and, as a rule, only manipulated when a new system is installed. In other respects, the connectors held in the modular connector are also disengaged when the two halves of the modular connector are separated from one another.

The invention claimed is:

1. A device for securing a connector in an insulating module housing of a modular connector, wherein the module housing contains a connecting region with at least one electrically isolated locating spring arranged therein, wherein a spring end of said locating spring is aligned in a connecting direction and protrudes into the connecting region, whereby to generate a wedge effect against insulating walls of an installed connector.

2. The device according to claim 1, wherein the locating spring is integrally formed onto the module housing within the connecting region.

3. The device according to claim 1, wherein the locating spring is integrated into a flat, U-shaped spring element, and the locating spring protrudes from the spring element opposite to the U-shape with its end.

4. The device according to claim 1, wherein the spring element is inserted into slots in the connecting region of the module housing.

5. The device according to claim 1, wherein at least one opening is provided in a bottom region of the module housing.

6. The device according to claim 2, wherein the spring element is inserted into slots in the connecting region of the module housing.

7. The device according to claim 2, wherein at least one opening is provided in a bottom region of the module housing.

8. The device according to claim 3, wherein the spring element is inserted into slots in the connecting region of the module housing.

9. The device according to claim 3, wherein at least one opening is provided in a bottom region of the module housing.

* * * * *